US010032216B2

(12) United States Patent
Binion et al.

(10) Patent No.: US 10,032,216 B2
(45) **Date of Patent: *Jul. 24, 2018**

(54) METHOD AND SYSTEM FOR A VEHICLE AUCTION TOOL WITH VEHICLE CONDITION ASSESSMENTS

(71) Applicant: STATE FARM MUTUAL AUTOMOBILE INSURANCE COMPANY, Bloomington, IL (US)

(72) Inventors: Todd Binion, Bloomington, IL (US); Kelly S. Minter, Normal, IL (US); Heidi Brown-McCreery, Bloomington, IL (US); Michael Harris, Normal, IL (US); Jeremy Myers, Normal, IL (US); Brian Fields, Normal, IL (US); Joe Harr, Bloomington, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,274

(22) Filed: Oct. 7, 2013

(65) Prior Publication Data

US 2015/0100448 A1 Apr. 9, 2015

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 20/204; G06Q 30/02–30/0643
USPC ..... 705/14.1–14.73, 26.1–27.2
See application file for complete search history.

(56) References Cited

U.S. PATENT DOCUMENTS

| | | | |
|---|---|---|---|
| 3,702,989 | A | 11/1972 | Provenzano, Jr. et al. |
| 3,866,166 | A | 2/1975 | Kerscher, III et al. |
| 4,027,289 | A | 5/1977 | Toman |
| 4,159,531 | A | 6/1979 | McGrath |

(Continued)

OTHER PUBLICATIONS

Honeycutt, Earl D., et al. "Determinants of ethical behavior: A study of autosalespeople." Journal of Business Ethics 32.1 (2001): 69-79. (Year: 2001).*

(Continued)

*Primary Examiner* — Matthew E Zimmerman
(74) *Attorney, Agent, or Firm* — Marshall, Gerstein & Borun LLP; Randall G. Rueth

(57) ABSTRACT

A method for buying and selling vehicles includes receiving information identifying a vehicle, retrieving condition data corresponding to the vehicle from a condition database, wherein a device inside the vehicle generates at least some of the condition data while the vehicle is being operated, and analyzing the condition data to determine a condition of the vehicle, wherein the condition of the vehicle relates to at least one of a quality or a value of the vehicle. Further, the method includes communicating an indication of the vehicle condition to an end user device, and, in response to the indication of the vehicle condition, receiving an offer to purchase the vehicle. A notification is generated based on the offer to purchase the vehicle, wherein the notification indicates a status of a purchase of the vehicle according to the offer to purchase the vehicle, and the notification is communicated to the end user device.

18 Claims, 5 Drawing Sheets

(56) References Cited

U.S. PATENT DOCUMENTS

| | | | | |
|---|---|---|---|---|
| 4,258,421 | A | 3/1981 | Juhasz et al. | |
| 5,361,201 | A | 11/1994 | Jost et al. | |
| 5,797,134 | A | 8/1998 | McMillan et al. | |
| 5,941,915 | A | 8/1999 | Federle et al. | |
| 6,289,332 | B2 | 9/2001 | Menig et al. | |
| 6,502,080 | B1 | 12/2002 | Eichorst et al. | |
| 6,526,335 | B1 | 2/2003 | Treyz et al. | |
| 6,654,770 | B2 | 11/2003 | Kaufman | |
| 6,711,495 | B1 | 3/2004 | Ukai et al. | |
| 7,111,005 | B1 * | 9/2006 | Wessman | G06F 21/604 |
| 7,174,243 | B1 | 2/2007 | Lightner et al. | |
| 7,676,306 | B2 | 3/2010 | Kubo et al. | |
| 7,711,574 | B1 | 5/2010 | Bradley et al. | |
| 7,765,039 | B1 | 7/2010 | Hagenbuch | |
| 8,014,974 | B2 | 9/2011 | Doddek et al. | |
| 8,140,358 | B1 | 3/2012 | Ling et al. | |
| 8,838,324 | B2 | 9/2014 | Suzuki et al. | |
| 2002/0065698 | A1 | 5/2002 | Schick et al. | |
| 2002/0143646 | A1 * | 10/2002 | Boyden | G06Q 30/08 705/26.3 |
| 2003/0009270 | A1 | 1/2003 | Breed | |
| 2004/0019517 | A1 | 1/2004 | Sennott | |
| 2004/0024483 | A1 | 2/2004 | Holcombe | |
| 2004/0153356 | A1 | 8/2004 | Lockwood et al. | |
| 2005/0154657 | A1 | 7/2005 | Kim et al. | |
| 2006/0033625 | A1 | 2/2006 | Johnson et al. | |
| 2006/0053075 | A1 | 3/2006 | Roth et al. | |
| 2006/0114531 | A1 | 6/2006 | Webb et al. | |
| 2006/0253293 | A1 | 11/2006 | Osborn | |
| 2007/0136077 | A1 | 6/2007 | Hammond et al. | |
| 2008/0046383 | A1 | 2/2008 | Hirtenstein et al. | |
| 2010/0005010 | A1 | 1/2010 | Chenn | |
| 2010/0106534 | A1 | 4/2010 | Robinson et al. | |
| 2010/0274571 | A1 * | 10/2010 | McFall | G06Q 30/06 705/1.1 |
| 2010/0318451 | A1 | 12/2010 | Niccolini et al. | |
| 2011/0264278 | A1 | 10/2011 | Gilbert et al. | |
| 2012/0197699 | A1 * | 8/2012 | Snell et al. | 705/14.11 |
| 2012/0209634 | A1 * | 8/2012 | Ling et al. | 705/4 |
| 2012/0246036 | A1 * | 9/2012 | Marr et al. | 705/27.1 |
| 2012/0262283 | A1 | 10/2012 | Biondo et al. | |
| 2013/0157647 | A1 | 6/2013 | Kolodziej | |
| 2014/0052501 | A1 | 2/2014 | Dickson et al. | |
| 2014/0058618 | A1 | 2/2014 | Rude et al. | |
| 2014/0095047 | A1 | 4/2014 | Naylor | |
| 2014/0289078 | A1 * | 9/2014 | Paul | 705/26.61 |
| 2014/0310186 | A1 | 10/2014 | Ricci | |
| 2014/0322676 | A1 * | 10/2014 | Raman | G09B 19/167 434/65 |

OTHER PUBLICATIONS

Office Action in U.S. Appl. No. 14/047,268 dated Jan. 29, 2014.
Office Action in U.S. Appl. No. 14/047,279 dated Jan. 29, 2014.
Office Action in U.S. Appl. No. 14/047,256 dated Jan. 27, 2014.
Office Action in U.S. Appl. No. 14/047,259 dated Jan. 16, 2014.
CarFax Sample Report, www.CarFax.com, accessed at http://www.carfax.com/phoenix/vehicle_history/SampleReport.cfx?reportName=consumerMobileWeb, archived Nov. 2012, accessed Jul. 2014.
Office Action in U.S. Appl. No. 14/047,259 dated Aug. 1, 2014.
Office Action in U.S. Appl. No. 14/047,268 dated Aug. 1, 2014.
Office Action in U.S. Appl. No. 14/047,279 dated Aug. 7, 2014.
Office Action in U.S. Appl. No. 14/047,256 dated Aug. 13, 2014.
Office Action in U.S. Appl. No. 14/047,256 dated Dec. 15, 2014.
Office Action in U.S. Appl. No. 14/047,268 dated Dec. 19, 2014.
Office Action in U.S. Appl. No. 14/047,279 dated Dec. 23, 2014.
Office Action in U.S. Appl. No. 14/047,259 dated Mar. 2, 2015.
Office Action in U.S. Appl. No. 14/047,268 dated Mar. 26, 2015.

* cited by examiner

METHOD AND SYSTEM FOR A VEHICLE AUCTION TOOL WITH VEHICLE CONDITION ASSESSMENTS

TECHNICAL FIELD

The present disclosure generally relates to assessing the condition of a vehicle and, more particularly, to a method for gathering and analyzing condition related data.

BACKGROUND

When customers purchase used vehicles, they often encounter the challenge of assessing the actual condition of vehicles with limited access to information about the vehicles. In most cases, customers only have access to general information about vehicles, such as year, make, model, mileage and physical appearance. From such general information, it is impossible to accurately assess the condition of a vehicle, much less how the vehicle was driven (e.g. severe acceleration and braking, towing a trailer, etc.), where the vehicle was driven (rural areas, urban areas, the "salt belt," etc.), and under what conditions was the vehicle driven (e.g. traffic, highway, snow, etc.).

SUMMARY

In one embodiment, a computer-implemented method comprises receiving information identifying a vehicle via a computer network, retrieving, with one or more processors, condition data corresponding to the vehicle from a condition database, wherein a device inside the vehicle generates at least some of the condition data while the vehicle is being operated, and analyzing, with one or more processors, the condition data to determine a condition of the vehicle, wherein the condition of the vehicle relates to at least one of a quality or a value of the vehicle. Further, the method comprises communicating, via the computer network, an indication of the vehicle condition to an end user device, in response to the indication of the vehicle condition, receiving, via the computer network, an offer to purchase the vehicle, and generating, with one or more processors, a notification based on the offer to purchase the vehicle, wherein the notification indicates a status of a purchase of the vehicle according to the offer to purchase the vehicle, and communicating, via the computer network, the notification to the end user device.

In another embodiment, a computer-implemented method for buying and selling vehicles on a computing device including a user interface and a display device, comprises receiving, via the user interface, information identifying a vehicle, generating, with one or more processors, an identification message including at least some of the information identifying the vehicle of interest, and sending, via a network interface at the computing device, the identification message to a server. Further the method comprises, in response to the identification message, receiving, via the network interface at the computing device, condition information corresponding to the vehicle and reflecting a condition of the vehicle, wherein the condition of the vehicle is determined based on an analysis of condition data generated by a device inside the vehicle while the vehicle is being operated, and wherein the condition of the vehicles includes a value of the vehicle. Also, the method comprises rendering, with one or more processors, an image of at least part of the condition information, presenting, via the display device, the image of at least part of the condition information to a user of the computing device, receiving, via the user interface, an offer to purchase the vehicle, generating, with one or more processors, an offer message including the offer to purchase the vehicle, and sending, via the network interface at the computing device, the offer message to the server. Still further, the method comprises, in response to the offer message, receiving, via the network interface at the computing device, a notification indicating a status of a purchase of the vehicle according to the offer to purchase the vehicle, rendering, with one or more processors, an image of the notification, and presenting, via the display device, the image of the notification to the user of the computing device.

In yet another embodiment, a computer device for assessing the condition of a vehicle comprises one or more processors and one or more non-transitory memories coupled to the one or more processors, wherein the one or more memories include computer executable instructions stored therein that, when executed by the one or more processors, cause the one or more processors to: receive information identifying a vehicle via a computer network, retrieve condition data corresponding to the vehicle from a condition database, wherein a device inside the vehicle generates at least some of the condition data while the vehicle is being operated, and analyze, with one or more processors, the condition data to determine a condition of the vehicle, wherein the condition of the vehicle relates to at least one of a quality or a value of the vehicle. Further, when executed by the one or more processors, the computer executable instructions cause one or more processors to: communicate, via the computer network, an indication of the vehicle condition to an end user device, in response to the indication of the vehicle condition, receive, via the computer network, an offer to purchase the vehicle, generate, with the one or more processors, a notification based on the offer to purchase the vehicle, wherein the notification includes information related to the purchase of the vehicle, and communicate, via the computer network, the notification to the end user device.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such terms should not be interpreted to be limited in scope based on any statement made in any section of this patent (other than the language of the claims). To the extent that any term recited in the claims at the end of this patent is referred to in this patent in a manner consistent with a single meaning, that is done for the sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

As used herein, the term "vehicle" may refer to any of a number of motorized transportation devices. A vehicle may be a car, truck, bus, train, boat, plane, etc. Additionally, as used herein, the term "driver" may refer to any operator of a vehicle. A driver may be a car driver, truck driver, bus driver, train engineer, captain of a boat, pilot of an airplane, etc.

System Overview

Figure 1:
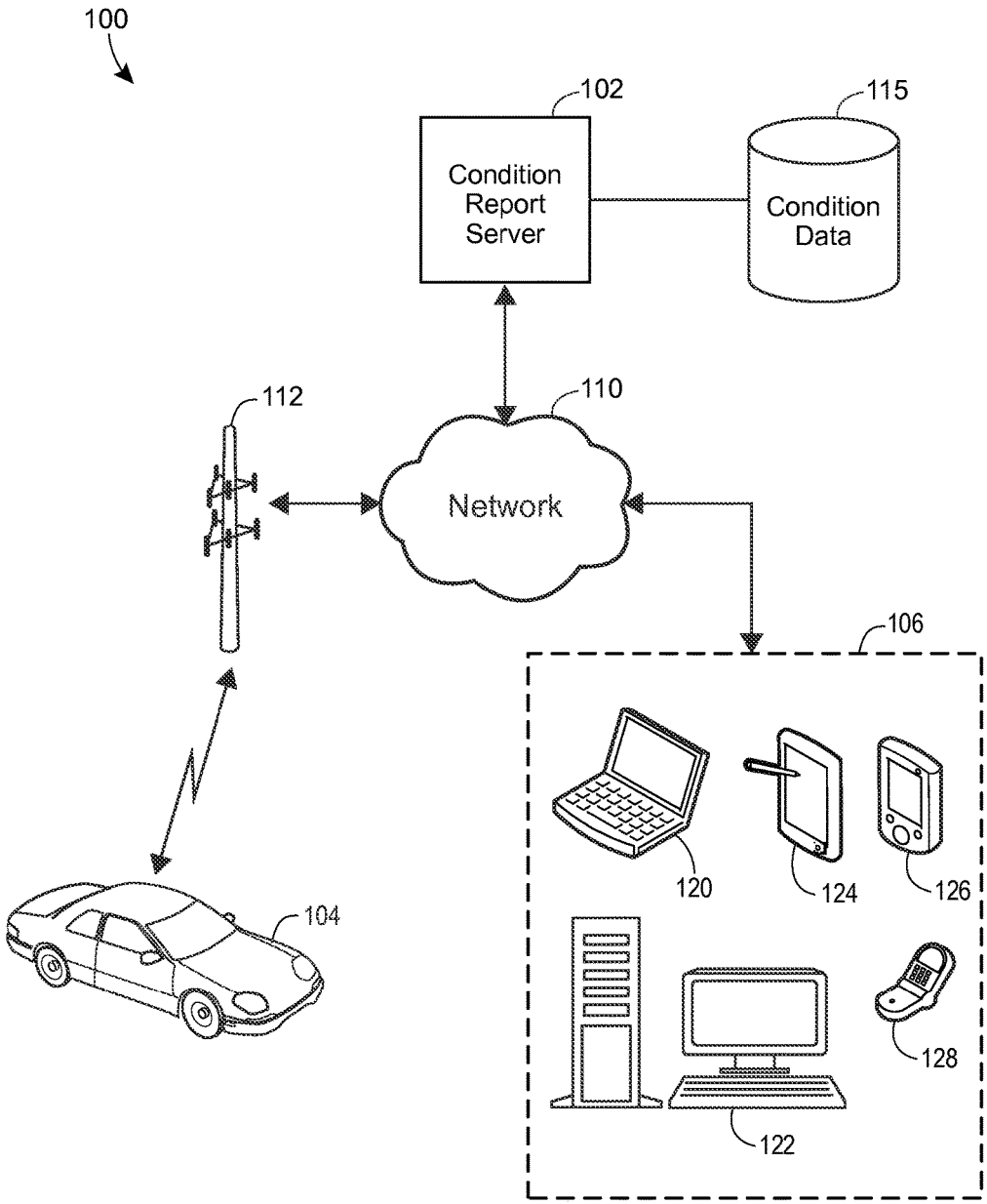
FIG. 1 illustrates an example system in which a condition report server may assess the condition of a vehicle.

FIG. 1 illustrates an example system 100 in which the condition of a vehicle 104 can be assessed for a vehicle auction. A condition report server 102 and one or more end user devices 106 are communicatively coupled to a network 110. Additionally, the vehicle 104 is communicatively coupled to the network 110 via an antenna 112. The network 110 may be a proprietary network, a secure public internet, a virtual private network or some other type of network, such as dedicated access lines, plain ordinary telephone lines, satellite links, combinations of these, etc. Where the network 110 comprises the Internet, data communications may take place over the network 110 via an Internet communication protocol. Further details of an example condition report server and an example end user device are described with reference to FIG. 2 and FIG. 3, respectively.

In some implementations, the vehicle 104 may upload condition data to the condition report server 102 via the network 110. For example, an on-board computing device (not shown) or end user device disposed in the vehicle 104 may wirelessly upload data from braking, acceleration, motion, force, environment, image, etc. sensors, via one or more wireless interfaces (not shown), for assessing the condition of the vehicle 104. In turn, the condition report server 102 may store the condition data in a condition database 115 that is communicatively coupled to the condition report server 102. The condition database 115 may include an assortment of computer-readable media. By way of example and without limitation, computer-readable media may include both volatile and nonvolatile media, removable and non-removable media.

Although the example system 100 is shown to include one condition report server 102 and five end user devices 106, it is understood that different numbers of servers and end user devices may be utilized. Furthermore, the processing performed by the condition report server 102 may be distributed among a plurality of servers in an arrangement known as "cloud computing," in an implementation. This configuration may provide several advantages, such as enabling near real-time uploads and downloads of information as well as periodic uploads and downloads of information, for example.

Figure 2:
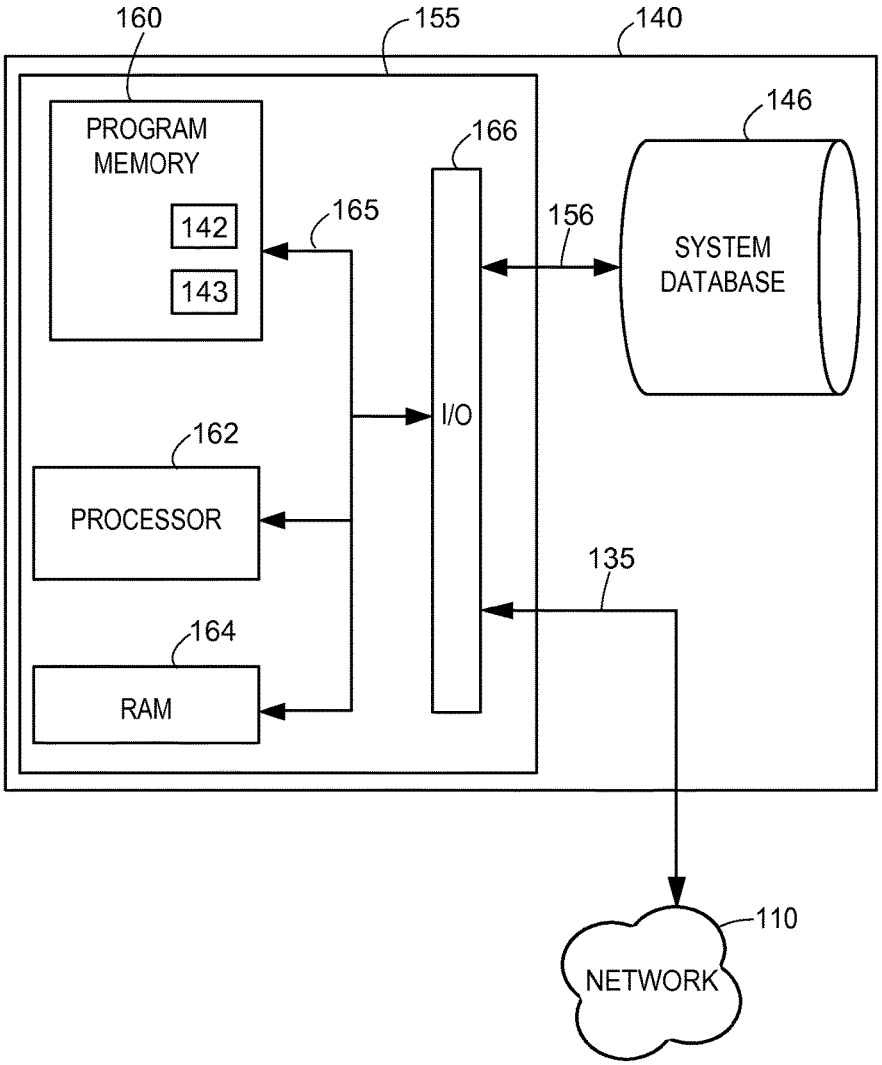
FIG. 2 illustrates an example server that can be implemented as the condition report server illustrated in FIG. 1.

FIG. 2 illustrates an example server 140 that may be implemented as a condition report server, such as the condition report server 102. The example server 140 includes a controller 155 that is operatively connected to the database 146 via a link 156, and it should be noted that, while not shown, additional databases may be linked to the controller 155 in a known manner. The controller 155 may include a program memory 160, a processor 162 (may be called a microcontroller or a microprocessor), a random-access memory (RAM) 164, and an input/output (I/O) circuit 166, all of which may be interconnected via an address/data bus 165. The program memory 160 may be configured to store computer-readable instructions that when executed by the processor 162 cause the server 140 to implement a server application 142 and a web server 143. The instructions for the server application 142 may cause the server 140 to implement the methods described herein.

While shown as a single block in FIG. 2, it will be appreciated that the server application 142 may include a number of different programs, modules, routines, and subroutines that may collectively cause the server 140 to implement the server application 142. It should be appreciated that although only one microprocessor 162 is shown, the controller 155 may include multiple microprocessors 162. Similarly, the memory of the controller 155 may include multiple RAMs 164 and multiple program memories 160. Further, while the instructions for the server application 142 and web server 143 are shown being stored in the program memory 160, the instructions may additionally or alternatively be stored in the database 146 and/or RAM 164. Although the I/O circuit 166 is shown as a single block, it should be appreciated that the I/O circuit 166 may include a number of different types of I/O circuits. The RAM(s) 164 and program memories 160 may be implemented as semiconductor memories, magnetically readable memories, and/or optically readable memories, for example. The controller 155 may also be operatively connected to the network 130 via a link 135.

Figure 3:
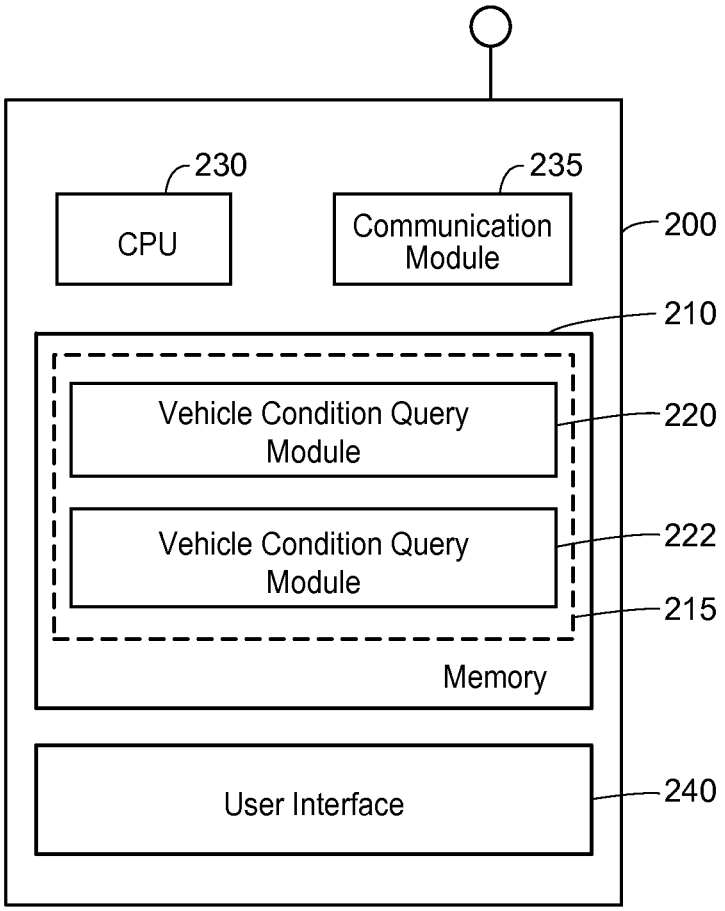
FIG. 3 illustrates an example end user device that can be implemented as one of the end user devices illustrated in FIG. 1.

FIG. 3 illustrates an example end user device 200 capable of reporting vehicle condition information to a customer, as discussed below. The end user device 200 may be implemented as one of the end user devices 106, for example. The end user device 200 includes a computer readable memory 210 in the form of volatile and/or nonvolatile memory such as read only memory (ROM) and random access memory (RAM). The memory 210 may store a vehicle condition reporting tool 215 including a vehicle condition query module 220 and a vehicle condition reporting module 222 to be executed by a CPU 230. In one implementation, the vehicle condition reporting tool 215 may be available at an online application store disposed at an application server (not shown), for example. A user may retrieve a copy of the vehicle condition reporting tool 215 from the server and "install" the retrieved copy of the vehicle condition reporting tool 215 on the end user device 200.

In other implementations, the end user device 200 is capable of executing a graphical interface (GUI) for an online vehicle condition reporting tool within a web browser application, such as Apple's Safari®, Google Android™ mobile web browser, Microsoft Internet Explorer®, etc. The web browser application may be implemented as a series of machine-readable instructions for receiving, interpreting, and displaying web page information (e.g. from web server 143) while also receiving inputs from the user.

Further, the portable device 200 includes a communication module 235, that facilitates wireless communication for data exchange over a mobile and/or wide area network, and a user interface 240. The user interface may include devices to receive inputs from a user, such as a keyboard, touchscreen, buttons, trackballs, etc., and display devices, such as liquid crystal displays (LCD), light emitting diodes (LED), organic light-emitting diodes (OLED), ePaper displays, etc.

Vehicle Condition Assessment

Figure 4:
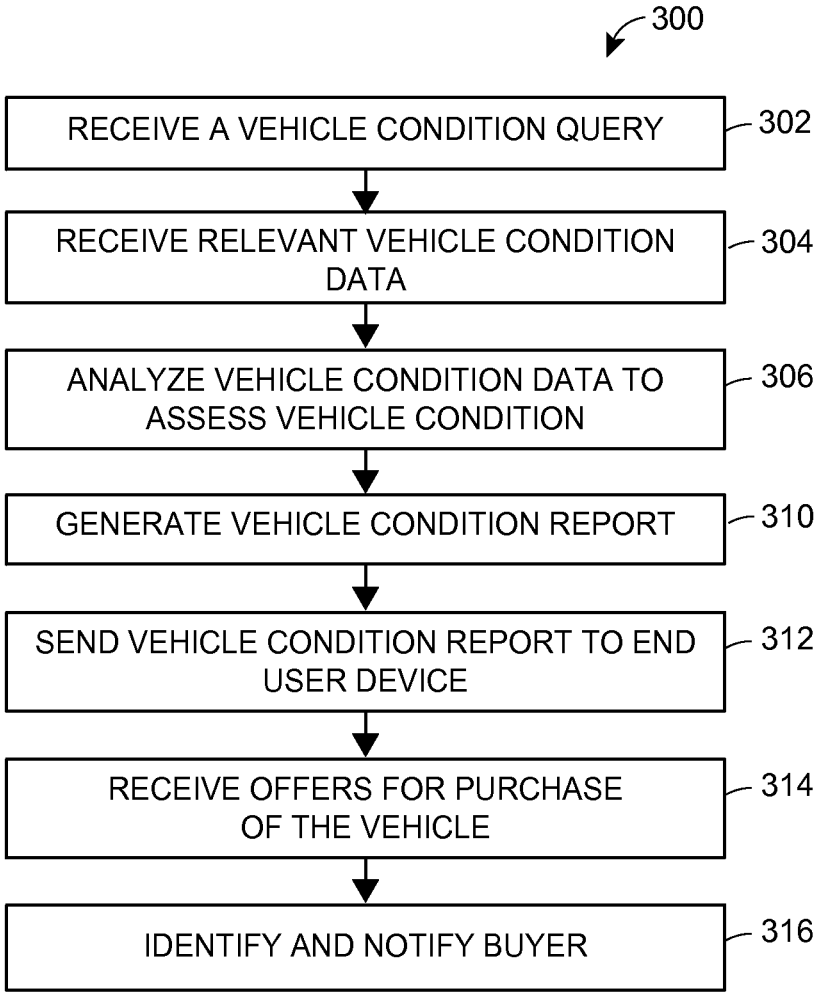
FIG. 4 is a flow diagram of an example method for assessing the condition of a vehicle and subsequently selling that vehicle.

FIG. 4 is a flow diagram of an example method 300 for assessing the condition of a vehicle and facilitating the sale of the vehicle. The method 300 may be implemented in the condition report server 102, for example.

To begin, a vehicle condition query is received from an end user device (block 302). In one scenario, a user of one of the end user devices 106 may locate a used car for sale and input, via a user interface, information identifying the used car, via a user interface to one of the end user devices 106. For example, the information identifying the used car may include a license plate number, license plate state, manufacturer name, model name or number, color, vehicle identification number (VIN), registered owner name, owner contact information, insurance policy number, etc. In turn, the one of the end user devices 106 may send a vehicle condition query, including the information identifying the vehicle, to the condition report server 102 to obtain an assessment of the condition (e.g. quality or market value) of the used car, in the example scenario. In another scenario, the registration or entry of a vehicle in an online auction may trigger the communication of a vehicle condition query corresponding to the vehicle.

In some implementations, a vehicle condition query may include only vehicle interest information. For example, a user of the one or more end user devices 106 may input information related to a types of vehicles or specific vehicles the user is interested in purchasing. In such an implementation, the condition report server 102 may match certain vehicles, with corresponding condition data in the condition database 115, to the vehicle interest data. For example, the vehicle interest data may include an indication that the user is interested in a 1995 Jeep Wrangler within a certain geographic area. The condition server may query the condition database, as known in the industry, to find all such vehicles within the geographic area and subsequently assess the condition of the matched vehicles, as described below. In some implementations, the condition server 102 may only assess the condition of a pre-defined, or otherwise determined, number of matched vehicles. Further details regarding vehicle interest information are discussed with reference to FIG. 5.

Upon receiving the vehicle condition query, condition data corresponding to the identified vehicle is retrieved from a vehicle condition database (block 304), such as condition database 115. In some implementations, the condition data may include data gathered from a variety of data sources, as described in U.S. application Ser. No. 13/897,646 entitled "Systems and Methods to Identify and Profile a Vehicle Operator" and filed on May 20, 2013, the entire disclosure of which is hereby incorporated by reference herein. By way of example and without limitation, such data sources may include: (i) sensors installed in vehicles, such as braking/acceleration/cornering sensors, tire pressure sensors, cameras, microphones, engine temperature sensors, mileage sensors, clocks, etc., (ii) sensors in mobile devices (e.g. smartphones, tablet computers, geopositioning receivers, etc.), where the mobile devices are temporarily disposed in vehicles, and (iii) third party databases (e.g. public record databases, insurance databases, etc.).

In some implementations, the condition data corresponding to the vehicle may be immediately descriptive of vehicle condition or descriptive of vehicle condition after manipulation. For example, data indicating vehicle mileage, year, and previous collisions/incidents may be immediately descriptive of the condition of a vehicle. On the other hand, engine rotations per minute (RPM), braking profiles, and geographic locations are example types of data that may be descriptive of the condition of a vehicle only after manipulation. In one scenario, an analysis of engine RPM data may indicate that a vehicle is frequently used for towing a trailer, and towing a trailer may be highly correlated with vehicle depreciation and/or high maintenance costs, example factors related to vehicle condition.

In some implementations, owners of used vehicles may receive incentives for contributing condition data for storage in a condition database. For example, car dealerships may offer more money to buy a car that has corresponding condition data recorded over the life of the car, as compared with a car that has no recorded condition data. In another example, an insurance company may provide coupons, discounts, or other rewards to customers that contribute condition data from insured vehicles.

The condition data stored in the condition database 115 may, in some implementations, be protected against fraud. For example, the condition data collected from used vehicles may be collected in real-time (i.e. wirelessly communicated to the condition server 102 immediately after being generated) and stored in a secure database (e.g. protected by authentication, encryption, etc.). In such a way, vehicle operators, or other interested persons, are prevented from modifying vehicle condition data to inaccurately reflect good/bad vehicle conditions.

Returning to FIG. 4, the condition data, retrieved from a vehicle condition database, is analyzed to assess the condition of the vehicle (block 306), in an implementation. For example, the condition report server 102 may analyze the condition data to assess the condition of the vehicle in relation to quality and value (e.g. maintenance, longevity, cost of ownership, mechanical operation, aesthetic condition, etc.)

In a simple example scenario, the condition report server 102 may retrieve geopositioning data, acceleration/braking/cornering data, and maintenance history data from the condition database 115. The maintenance history data may indicate that a vehicle has a history free of frequent or severe maintenance/repair issues. However, the geopositioning data may indicate that the vehicle has primarily been driven in the "salt belt" region of the United States (a region where vehicles commonly encounter corrosion due to the use of road salt) and the acceleration/braking/cornering data may indicate erratic and severe acceleration, braking, and/or cornering (i.e. reckless driving). In such an example scenario, the condition report server 102 may assess the condition of the vehicle as relatively low quality/value because of probable current and/or future issues caused by the driving environment and driving behavior.

A customer considering only the maintenance history and general vehicle information (e.g. mileage, make, model, year, etc.) may overvalue the used car, in the above scenario. In contrast, the techniques of the present disclosure are able to provide an accurate assessment of vehicle quality by collectively analyzing condition data gathered from the vehicle over time, such as the geopositioning and acceleration/braking/cornering data in the above scenario, for example.

In some implementations, the condition report server 102 may collectively or comparatively analyze the condition data to assess vehicle condition. For example, mileage data may indicate a relatively high mileage (e.g. 100,000 miles as compared with an average of 75,000 miles for cars of the same year), whereas geopositioning data may indicate that the vehicle is predominately driven in rural areas of the state of Arizona. Independently, the high mileage may indicate low quality or value. However, when combined with geopositioning data, from which one could infer mostly highway driving (i.e. rural driving) in a dry climate (Arizona), the condition report server 102 may more moderately assess the vehicle quality and value, in the example case.

The condition report server 102 may assess both the past and future condition of the vehicle in addition to the current condition of the vehicle, in some implementations. The condition report server 102 may use prediction, modeling, simulation, or other suitable algorithms to infer a condition of a vehicle at times in the past and predict conditions of a vehicle in the future, for example. A prediction algorithm (e.g. trained on reference data) may predict that a certain vehicle will need brake replacement in one year, transmission service in two years, and tire replacement in one and a half years, in an example scenario.

Also, the condition report server 102 may use prediction, modeling, etc. algorithms to accurately assess the current condition of a vehicle, even when condition data is not available over the entire life, or age, of the vehicle. For example, condition data may be available for only five out of ten years of the life of a vehicle. In such a case, a simulation/modeling algorithm may stitch together the available data with simulations to provide an accurate assessment of current vehicle condition.

Once the vehicle condition is assessed, vehicle condition descriptors reflecting the condition of the vehicle are developed. The condition descriptors may include any suitable representation or representations of the condition of the vehicle, in an implementation. The condition descriptors may include, by way of example: (i) scores or ratings representing relative quality, value, mechanical operation, etc., such as a score between one and one hundred or a rating of one to five stars; (ii) text statements reflecting a condition, such as "low," "moderate," or "high" cost of ownership, "this car may have major repair needs within two years," etc.; (iii) graphical representations of condition information, such as graphs, plots, or charts indicating average engine temperature as a function of time, maintenance/repair events per year, etc.; (iv) images or icons, such as a thumbs up/down, caution sign icons, etc.

Next, a vehicle condition report is generated to be presented on an end user device (block 310). In some implementations, the vehicle condition report includes some or all of the condition descriptors developed at block 306. For example, the condition report server 102 may generate a vehicle condition report in the form of one or more web pages including at least some of the condition descriptors, where the web pages may be displayed via a web browser application executed on the one or more end user devices 106.

In some implementations, the vehicle condition report is interactive. For example, the condition report server 102 may develop a vehicle condition report in the form of one or more interactive web pages or in the form of content for an interactive vehicle condition reporting application. An initial web page may display a general representation of vehicle condition, such as a series of scores or ratings, and, upon customer selection of a score or rating, further or modified web pages may display more detailed information, such as graphs, tables, etc. or even portions of the raw condition data itself, for example.

The vehicle condition report is sent to an end user device for presentation to a user (block 312). In some implementations, the condition report server 102 may initially send a partial vehicle condition report to the end user device, and then, based on user interaction with the report, the condition report server 102 may send additional portions of the vehicle condition report. Further, the condition report server 102 may generate and send variations of the vehicle condition report based on end user device configurations, in an implementation. For example, the condition report server may generate one variation of a vehicle condition report for a visually appealing display on a smartphone and another variation of a vehicle condition report for a visually appealing display on a tablet, laptop, or desktop computer.

In response to the vehicle condition report, offers to purchase the vehicle may be received (block 314). For example, users of the one or more end user devices 106 may view a vehicle condition report and offer to buy the vehicle assessed in the condition report. In some implementations, a plurality of users may make offers or bids to purchase the vehicle with each offer being higher than the previous offer. For example, users of the one or more end user devices 106 may view a current offer to buy the vehicle 104 as part of the vehicle condition report, and the condition report server 102 may communicate updates to the current offer periodically or each time a new offer is received.

In an implementation, the owner of the vehicle 104 or a third party auction service may generate the vehicle condition query and advertise the vehicle 104 to other users of a vehicle condition reporting tool. For example, users of the one or more end user devices 106 may initiate a vehicle condition reporting tool, such as vehicle condition reporting tool 215, which, in turn, displays vehicles available for purchase along with vehicle condition reports corresponding to the vehicles available for purchase. Moreover, in some implementations, users of a vehicle condition reporting tool may view vehicle condition reports corresponding to vehicles that are not available for purchase, and the users may still make offers to buy a vehicle that is not available for purchase or inquire as to when the vehicle will be available for purchase.

Finally, a buyer is identified, among the users who submitted an offer to purchase the vehicle, and the buyer is notified (block 316). For example, the condition report server 102 may identify a buyer as the user with the highest offer or the highest offer within a certain amount of time. Alternatively, the owner of a vehicle may specify criteria for a potential buyer, and communicate the criteria to the condition report server 102. For example, the condition report server may identify the buyer as the user with the highest offer and, according to criteria defined by the owner of the vehicle 104, is within a certain geographic area of the owner of the vehicle 104.

In some implementations, the buyer and/or the owner of the vehicle is notified of the final purchase price of the vehicle, the identity of the buyer, the contact information of the buyer/seller, etc. (block 318). For example, the buyer of the vehicle may be electronically contacted via email, text message, mobile phone alert, etc. with information indicating a successful purchase of the vehicle and instructions for completing purchase of the vehicle.

Vehicle Condition Reporting and Auction Tool

Figure 5:
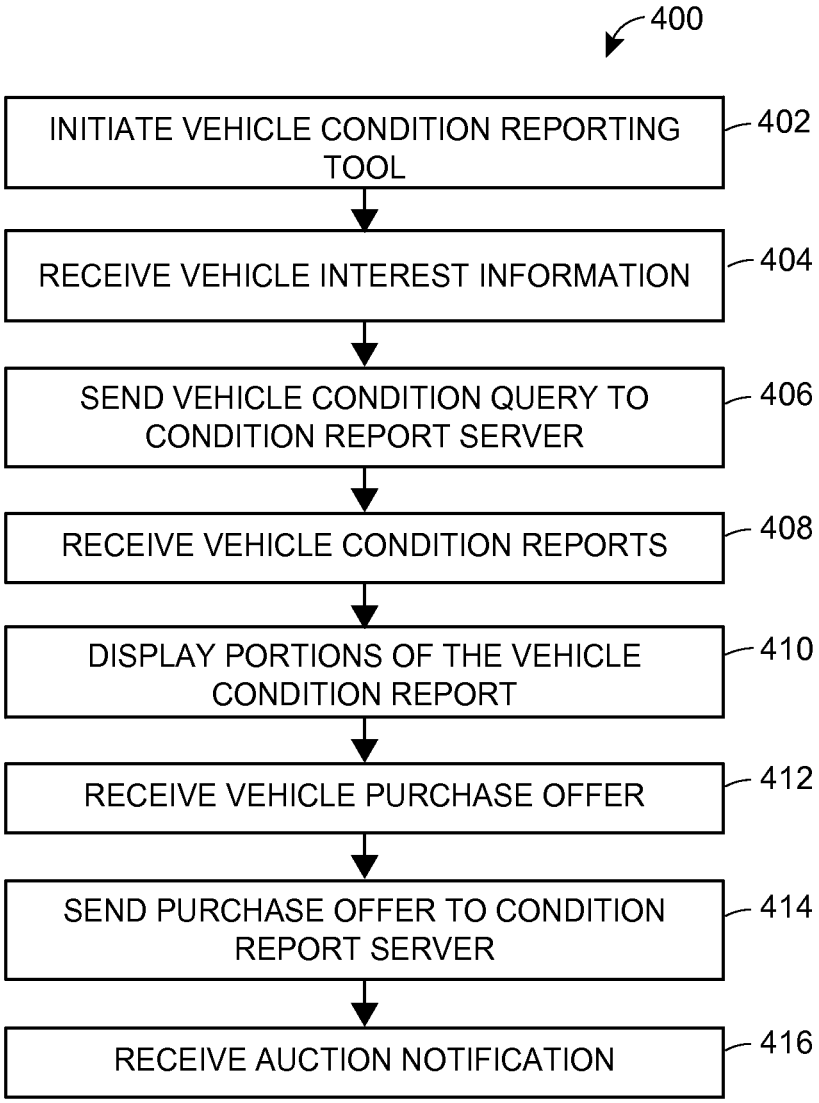
FIG. 5 is a flow diagram of an example method for a vehicle condition reporting tool including a vehicle auction.

FIG. 5 is a flow diagram of an example method 400 for reporting vehicle condition information and vehicle auction information on an end user device. The method 440 may be implemented by the one or more end user devices 106, for example.

To begin, a vehicle condition reporting tool is initiated (block 402). In one implementation, one of the end user devices 106 may execute a vehicle condition reporting tool stored in memory (e.g. the vehicle condition reporting tool 215), where the vehicle condition reporting tool facilitates communications with the condition report server 102 and the display of vehicle condition reports and vehicle auction information. In another implementation, a user of one of the end user devices 106 may initiate a vehicle condition reporting tool via a web browser application.

Next, vehicle interest information, related to vehicles a user is interested in purchasing, is received via a user interface (block 404), such as the user interface 240. In some implementations, one of the end user devices 106 may display a series of forms, questions, buttons, etc. to prompt a user of one of the end user devices 106 to enter vehicle interest information. For example, the vehicle interest information may include indications of types of vehicles (e.g. truck, sport utility vehicle, luxury car, etc.), vehicle characteristics (e.g. four-door, power windows, heated seats, etc.), price ranges, preferred conditions (e.g. good/moderate/bad conditions, mileage, no major mechanics issues, etc.), or any other suitable indications that generally define a vehicle of interest. Alternatively, the vehicle interest information may include identifications of particular vehicles, in an implementation. For example, a user may identify a vehicle of interest at a car dealership, via personal interaction with the owner of the vehicle, via an online advertisement, etc. The user may enter (e.g. via the vehicle condition reporting tool) a VIN number, or other unique identification of the vehicle, for example.

In another implementation, a user of an end user device may use sensors in the device itself to automatically generate vehicle interest information. For example, a camera on a smartphone may capture an image of a license plate or scan a bar code representing a VIN number. In such a case, the end user device may analyze the automatically generated data and, in some implementations, transform the data into convenient formats (e.g. text, numbers, etc.) for vehicle identification.

Once vehicle interest information is received, a vehicle condition query is sent to a condition report server (block 406). The vehicle condition query includes the vehicle interest information, and, in some implementations, the vehicle condition query includes device specific information. For example, the vehicle condition query may include device specific information indicating device configurations (e.g. hardware, software, etc.), device users (e.g. usernames, passwords, identification numbers, etc.), device locations, etc.

Returning to FIG. 5, one or more vehicle condition reports, corresponding to vehicles that match the vehicle interest information, are received (block 408). For example, the condition report server 102 may electronically communicate the vehicle condition reports to one of the end user devices as web content for display in a vehicle condition reporting tool or web browser. In addition, the condition report server 102 may send the vehicle condition reports via email, text message, or hyperlink, for example.

In some implementations, the condition report server 102 may use device specific information to customize vehicle condition reports. For example, the condition report server may use a device location to generate vehicle condition reports emphasizing relevant vehicle condition descriptors (e.g. through prominent display, icons, bold text, etc.).

In one scenario, an end user device may be located in an area with severe winter weather, and, as such, the condition report server may generate a vehicle condition reports that emphasize mechanical operation issues, repair issues, etc. that would be particularly relevant in cold climates (e.g. problems with a four wheel drive differential, problems starting an engine in cold weather, etc.). In another example, the condition report server 102 may customize vehicle condition reports for individual device users. In one scenario, a device user may indicate (via a user interface) that maintenance issues are not as important as vehicle aesthetic condition (e.g. paint condition, body condition, etc.). As such, the condition report server 102 may display information regarding vehicles aesthetics predominately in a vehicle condition report or analyze data related to aesthetics in more detail, for example.

Upon receiving the vehicle condition report, all or part of the vehicle condition report is displayed (block 410). For example, one of the end user devices 106 may display interactive web pages or other interactive vehicle condition content, as described with reference to FIG. 4. In some implementations, one of the end user devices 106 may download or view the vehicle condition report as a document, such as a portable document format (PDF) document, Microsoft Excel® spreadsheet, or other suitable document. For example, one of the end user device 106 may save a vehicle condition report document in computer-readable memory or print a vehicle condition report document for later viewing. Also, a user may "share" part or all of a vehicle condition report with friends, potential buyers, etc. via email, text message, hyperlink, Facebook®, etc., in some implementations An end user device or condition report server may compare vehicle condition reports for multiple vehicles, matching the vehicle interest information, to create a comparison chart, relative scoring or rating of vehicles, or other suitable representation of the comparison of vehicle condition reports, in an implementation. For example, a user may save multiple vehicle condition reports (generated at different times) in the memory of one of the end user devices 106 and select the multiple vehicle condition reports to generate a vehicle condition comparison.

Next, an offer to purchase a vehicle may be received via a user interface of an end user device (block 412). For example, the one or more end user devices 106 may display text boxes, buttons, etc. for entering an offer to purchase one of the vehicles matching the vehicle interest information. In some implementations, vehicle condition reports may include suggested offer values, minimum offer values, or offer values pre-approved by the vehicle owner. In such a case, a user of the one or more end user devices 106 may select one of these offer values (e.g. via a click or tap) to submit an offer of that offer value.

Next, the offer to purchase the vehicle (received at block 412) is communicated to the condition report server (block 414). The offer to purchase the vehicle may be sent to the condition report server in any suitable form, such as a numerical value, text file, etc., for example. As mentioned above, the condition report server 102 may update the current offer on the vehicle according to the newly received offer.

In response to the communication of the offer, an auction notification is received (block 416). The auction notification may include, by way of example, a notification of purchase of a vehicle by the user, purchase of a vehicle by another party, an updated offer, termination of a vehicle auction, instructions to complete payment for a vehicle purchase, and of other vehicles of potential interest to the user. In some implementations, a user may display further portions of vehicle condition reports or different vehicle condition reports in response to the auction notification. Further, a user may make higher/different offers to purchase a vehicle in response to the auction notification.

We claim:

1. A computer-implemented method comprising:

receiving, from a first end user device corresponding to a potential buyer via a computer network, a vehicle condition descriptor indicative of a vehicle condition of vehicles of interest to the potential buyer;

matching, with the one or more processors, the vehicle condition descriptor to a vehicle offered for sale;

retrieving, with the one or more processors, condition data corresponding to the vehicle offered for sale from a condition database, wherein at least some portions of the condition data are generated by a second end user device when the second end user device is inside the vehicle offered for sale while the vehicle offered for sale is being operated, wherein the at least some portions of the condition data are collected from the second end user device contemporaneous to the second end user device generating the at least some portions of the condition data, the second end user device including at least one of a phone, a tablet computer, or a laptop computer, and wherein at least some other portions of the condition data are generated by an on-board device inside the vehicle offered for sale while the vehicle offered for sale is being operated, wherein the at least some other portions of the condition data are collected from the on-board device contemporaneous to the on-board device generating the at least some other portions of condition data, the on-board device including at least two or more of: a motion sensor, a camera, an audio sensor, a biometric sensor, a clock, and an on-board geopositioning receiver, and wherein the on-board device is distinct from the second end user device;

encrypting, with the one or more processors, the condition data collected from the second end user device and the on-board device;

storing, with the one or more processors, the encrypted condition data in the condition database;

analyzing, with the one or more processors, the condition data to determine one or more vehicle condition descriptors of the vehicle offered for sale, wherein the vehicle condition descriptors of the vehicle offered for sale indicate at least one of a market value, a future predicted condition, and a quality level of the vehicle offered for sale;

communicating, via the computer network, an indication of the vehicle offered for sale to the first end user device corresponding to the potential buyer, wherein the indication includes a condition report that indicates the one or more condition descriptors of the vehicle offered for sale;

in response to communicating the indication of the vehicle offered for sale, receiving, from the first end user device corresponding to the potential buyer via the computer network, an offer to purchase the vehicle offered for sale;

generating, with the one or more processors, a notification based on the offer to purchase the vehicle offered for sale, wherein the notification indicates a status of a purchase of the vehicle according to the offer to purchase the vehicle offered for sale; and communicating, via the computer network, the notification to the first end user device corresponding to the potential buyer.

2. The computer-implemented method of claim 1, further comprising receiving, from the end user device corresponding to the potential buyer via the computer network, an identification of the vehicle offered for sale including at least one of a license plate number, license plate state, manufacturer name, year of manufacture, name of insurance company, model name or number, color, vehicle identification number (VIN), registered owner name, owner contact information, or insurance policy number.

3. The computer-implemented method of claim 1, wherein the vehicle condition descriptors of the vehicle further indicate at least one of a relative quality, a trade-in value, or a state of mechanical operation of the vehicle offered for sale.

4. The computer-implemented method of claim 1, wherein the condition data includes current or prior geographic location data, mileage data, time or date data, vehicle operator behavior data, vehicle collision data, repair or maintenance data, vehicle title data, vehicle usage data, recall data, vehicle operator preference data, or driving violation data.

5. The computer-implemented method of claim 1, wherein the condition report includes one of text, image, graph, plot, chart, or table based representations of the condition of the vehicle.

6. The computer-implemented method of claim 1, wherein the condition report includes a suggested, minimum, or owner-defined purchase price of the vehicle offered for sale.

7. The computer-implemented method of claim 1, wherein the notification includes at least one of:

(i) a notification of the purchase of the vehicle offered for sale according to the offer to purchase the vehicle, (ii) a notification of the purchase of the vehicle offered for sale according to a different offer to purchase the vehicle, (iii) a notification of instructions to complete the purchase of the vehicle offered for sale, (iv) a notification of an updated minimum offer for the vehicle offered for sale, or (v) a notification of similar vehicles available for purchase.

8. The computer-implemented method of claim 1, wherein the notification includes at least one of a list of vehicles offered for sale for which condition information was viewed, a number of bids or offers for purchasing the vehicle offered for sale, a max bid for the vehicle offered for sale, description or condition updates for the vehicle offered for sale, or instructions and information regarding the purchasing of vehicles offered for sale.

9. A computer-implemented method for buying and selling vehicles on a computing device including a user interface and a display device, the method comprising:

receiving from a potential buyer, via the user interface, a vehicle condition descriptor indicative of a vehicle condition of interest to a potential buyer;

generating, with one or more processors, an identification message including the vehicle condition descriptor;

sending, via a network interface at the computing device, the identification message to a server;

in response to sending the identification message, receiving, via the network interface at the computing device, a condition report corresponding to a vehicle offered for sale and indicating one or more vehicle condition descriptors of the vehicle offered for sale, wherein the one or more vehicle condition descriptors of the vehicle offered for sale are determined based on an analysis of condition data, wherein at least some portions of the condition data are generated by an end user device when the end user device is inside the vehicle offered for sale while the vehicle offered for sale is being operated, wherein the at least some portions of the condition data are collected from the end user device contemporaneous to the end user device generating the at least some portions of the condition data, the end user device including at least one of a phone, a tablet computer, or a laptop computer, and wherein at least some other portions of the condition data are generated by an on-board device inside the vehicle offered for sale while the vehicle offered for sale is being operated, wherein the at least some other portions of the condition data are collected from the on-board device contemporaneous to the on-board device generating the at least some other portions of the condition data, the on-board device including at least two or more of: a motion sensor, a camera, an audio sensor, a biometric sensor, a clock, and an on-board geopositioning receiver, and wherein the on-board device is distinct from the end user device, and wherein the one or more vehicle condition descriptors of the vehicle offered for sale indicate at least one of a market value, a future predicted condition, and a quality level of the vehicle offered for sale, and wherein the future predicted condition is a need for vehicle maintenance;

encrypting, with the one or more processors, the condition data collected from the end user device and the on-board device;

storing, with the one or more processors, the encrypted condition data in the condition database;

rendering, with the one or more processors, an image of at least part of the condition report;

presenting, via the display device, the image of at least part of the condition report to the potential buyer;

receiving from the potential buyer, via the user interface, an offer to purchase the vehicle offered for sale;

generating, with the one or more processors, an offer message including the offer to purchase the vehicle offered for sale;

sending, via the network interface at the computing device, the offer message to the server;

in response to the sending offer message, receiving, via the network interface at the computing device, a notification indicating a status of a purchase of the vehicle offered for sale according to the offer to purchase the vehicle;

rendering, with the one or more processors, an image of the notification; and presenting, via the display device, the image of the notification to the potential buyer.

10. The computer-implemented method of claim 9, further comprising receiving from the potential buyer, via the user interface, an identification of the vehicle offered for sale including at least one of a license plate number, license plate state, manufacturer name, year of manufacture, name of insurance company, model name or number, color, vehicle identification number (VIN), registered owner name, owner contact information, or insurance policy number.

11. The computer-implemented method of claim 9, wherein the vehicle condition descriptors of the vehicle further indicates at least one of a relative quality, a trade-in value, or a state of mechanical operation of the vehicle offered for sale.

12. The computer-implemented method of claim 11, wherein the condition data includes current or prior geographic location data, mileage data, time or date data, vehicle operator behavior data, vehicle collision data, repair or maintenance data, vehicle title data, vehicle usage data, recall data, vehicle operator preference data, or driving violation data.

13. The computer-implemented method of claim 9, wherein the condition report includes one of text, image, graph, plot, chart, or table based representations of the condition of the vehicle.

14. The computer-implemented method of claim 9, wherein the condition report includes a suggested, minimum, or owner-defined purchase price of the vehicle offered for sale.

15. The computer-implemented method of claim 14, wherein the offer to purchase the vehicle offered for sale is a user modification of the suggested, minimum, or owner-defined purchase price of the vehicle.

16. The computer-implemented method of claim 14, wherein the offer to purchase the vehicle offered for sale is a user selection of the suggested, minimum, or owner-defined purchase price of the vehicle.

17. The computer-implemented method of claim 9, wherein the notification includes at least one of:

(i) a notification of the purchase of the vehicle offered for sale according to the offer to purchase the vehicle, (ii) a notification of the purchase of the vehicle offered for sale according to a different offer to purchase the vehicle, (iii) a notification of instructions to complete the purchase of the vehicle offered for sale, (iv) a notification of an updated minimum offer for the vehicle offered for sale, or (v) a notification of similar vehicles available for purchase.

18. A computer device for assessing the condition of a vehicle offered for sale, the computer device comprising:

one or more processors; and one or more non-transitory memories coupled to the one or more processors, wherein the one or more memories include computer executable instructions stored therein that, when executed by the one or more processors, cause the one or more processors to:

receive, from first end user device corresponding to a potential buyer via a computer network, a vehicle condition descriptor indicative of a vehicle condition of interest to a potential buyer;

match the vehicle condition descriptor to the vehicle offered for sale;

retrieve condition data corresponding to the vehicle offered for sale from a condition database, wherein a second end user device inside the vehicle offered for sale generates at least some portions of the condition data while the vehicle offered for sale is being operated, wherein the at least some portions of the condition data are collected from the second end user device contemporaneous to the second end user device generating the at least some portions of the condition data, the second end user device including at least one of a phone, a tablet computer, or a laptop computer, wherein at least some other portions of the condition data are generated by an on-board device inside the vehicle offered for sale while the vehicle offered for sale is being operated, wherein the at least some other portions of the condition data are collected from the on-board device contemporaneous to the on-board device generating the at least some other portions of the condition data, the on-board device including at least two or more of: a motion sensor, a camera, an audio sensor, a biometric sensor, a clock, and an on-board geopositioning receiver, and wherein the on-board device is distinct from the second end user device;

encrypting, with the one or more processors, the condition data collected from the second end user device and the on-board device;

storing, with the one or more processors, the encrypted condition data in the condition database;

analyze, with the one or more processors, the condition data to determine one or more vehicle condition descriptors of the vehicle offered for sale, wherein the vehicle condition descriptors of the vehicle offered for sale indicate at least one of a market value of the vehicle offered for sale and a future predicted condition of the vehicle offered for sale, and wherein the future predicted condition is a need for vehicle maintenance;

communicate, via the computer network, an indication of the vehicle offered for sale to the first end user device corresponding to the potential buyer, wherein the indication includes a condition report that indicates the one or more vehicle condition descriptors of the vehicle offered for sale;

in response to the indication of the vehicle offered for sale, receive, from the first end user device corresponding to a potential buyer via the computer network, an offer to purchase the vehicle offered for sale;

generate, with the one or more processors, a notification based on the offer to purchase the vehicle offered for sale, wherein the notification includes information related to the purchase of the vehicle offered for sale; and communicate, via the computer network, the notification to the first end user device corresponding to the potential buyer.

* * * * *